US006017294A

United States Patent [19]

Eschenbach

[11] Patent Number: 6,017,294

[45] Date of Patent: Jan. 25, 2000

[54] DUAD TREADLE EXERCISE APPARATUS

[76] Inventor: Paul William Eschenbach, 143 Lakeland Ave., Moore, S.C. 29369

[21] Appl. No.: 09/154,678

[22] Filed: Sep. 17, 1998

[51] Int. Cl.[7] ..... A63B 69/16; A63B 22/00

[52] U.S. Cl. ..... 482/52; 482/51

[58] Field of Search ..... 482/51–53, 57, 482/70, 79, 80, 148, 71

[56] References Cited

U.S. PATENT DOCUMENTS

| | | | |
|---|---|---|---|
| 5,060,935 | 10/1991 | Dunn et al. | 482/53 |
| 5,188,577 | 2/1993 | Young et al. | 482/53 |
| 5,344,371 | 9/1994 | Wang | 482/53 |
| 5,769,760 | 6/1998 | Lin et al. | 482/52 |
| 5,792,029 | 8/1998 | Gordon | 482/70 |

*Primary Examiner*—Stephen R. Crow

[57] ABSTRACT

A standup exercise apparatus simulates speed walking and climbing with elliptical arm exercise. Two pair of foot pedals move with an up and down treadle movement. Operation begins with a warm-up stretching movement on a first pair of pedals followed by a more aggressive climbing movement on a second set of pedals. Leg joint impact is controlled to be very low as to allow extended exercise without joint soreness. Arm exercise is coordinated with motion of the feet to simulate rowing in one direction of crank rotation and ski pole motion in the other direction of crank rotation. Two operators can exercise on the apparatus at the same time.

26 Claims, 3 Drawing Sheets

DUAD TREADLE EXERCISE APPARATUS

BACKGROUND OF THE INVENTION

1. Field

The present invention relates to a standup exercise apparatus that simulates speed walking and climbing with elliptical arm exercise that simulates rowing and ski pole motion. More particularly, the present invention relates to an exercise machine having separately supported pedals for the feet and arm exercise coordinated with the motion of the feet.

2. State of the Art

The benefits of regular exercise to improve overall health, appearance and longevity are well documented in the literature. For exercise enthusiasts the search continues for safe apparatus that provides full body exercise for maximum benefit in minimum time.

Up and down foot motion has become popular in the stepper category where the heel of the foot generally moves faster than the toe. Young et al. in U.S. Pat. No. 4,989,858 show independent foot support members that are pivoted forward the operator while Bull in U.S. Pat. No. 5,013,031 shows similar dependent foot support members. Robards, Jr. et al. In U.S. Pat. No. 5,135,447 offers a dependent stepper with a forward pivoted foot support member to drive an alternator. Dunn et al. in U.S. Pat. No. 5,135,448 use forward pivoted foot support members having paddles extending beyond the pivot for water exercise. Foster in U.S. Pat. No. 5,620,400 shows dependent forward pivot foot support members connected to hand levers for mountain climbing exercise. Chang in U.S. Pat. No. 4,961,570 shows dependent forward pivoted foot support members as part of a linkage having a crank to determine step range. Kuo in U.S. Pat. Nos. 4,989,857 and 5,039,087 uses forward pivoted foot support members powered by a motor through a crank.

The treadle category has the foot support members pivoted rearward the operator allowing the foot to move up and down wherein the toe moves faster than the heel. Brown in U.S. Pat. No. 3,316,898 shows foot support members slidably pivoted rearward the operator with direct crank up and down control. Encke in U.S. Pat. No. 3,814,420 offers foot support members pivoted rearward the operator with treadle motion controlled by lever action.

Schirrmacher in U.S. Pat. No. 4,561,318 and Chase, Sr. in U.S. Pat. No. 4,053,173 show lever power systems to drive a bicycle with rearward pivoted foot levers. Chen in U.S. Pat. No. 5,759,135 offers rearward pivoted foot support levers that telescope with crank operation. Gordon in U.S. Pat. No. 5,792,029 shows rearward pivoting foot support members that support foot trolleys for back and forth foot motion coordinated by belts to up and down foot support member motion.

Arm exercise with elliptical hand motion is recently appearing in the art. Rodgers, Jr. in U.S. Pat. No. 5,690,589 and Lin et al. in U.S. Pat. No. 5,769,760 show elliptical hand motion coordinated with elliptical foot motion.

There remains a need to combine up and down foot motion with elliptical hand motion to exercise muscles in an alternative manner. There also remains a need to combine stepper foot motion and treadle foot motion into one exercise apparatus offering the operator a variety of leg exercise.

SUMMARY OF THE INVENTION

The present invention relates to the kinematic motion control of pedals which simulate speed walking and climbing during operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through up and down movement while pedal angles are controlled to vary about the horizontal during the pedal cycle. Arm exercise is by arm levers coordinated with the mechanism guiding the foot pedals.

In the preferred embodiment, the apparatus includes a pair of foot support members pivoted at one end of a support framework to provide up and down treadle motion. Connecting links are pivotally attached intermediate each foot support member and are pivotally attached to a crank. The crank is pivotally attached to the framework generally above the intermediate foot support member. A first pair of pedals are positioned on the foot support members proximate the foot support member pivot. A second pair of pedals are attached to the foot support members at the other end distal the foot support member pivot. Handles with hand grips for arm exercise are attached to the connecting links.

Operation of the exercise apparatus begins with placement of the feet upon the first pair of pedals and grasping the handles. The hands initiate the movement to move along an elongate curve while the feet move up and down with the toe moving faster than the heel of the foot. This motion stretches the calf muscles for warm-up. After warm-up, the operator moves to the second set of pedals grasping the hand grips from the alternate side. The second set of pedals provide a more aggressive stepper motion with the heel of the foot moving faster than the toe. With either set of pedals, the hands can rotate the crank in either direction. Therefore, both pushing and pulling are possible for arm exercise on the upper and the lower portions of the elongate elliptical hand curve. Both rowing motion and ski pole motion are simulated. It is also understood that two friendly operators may use the exercise apparatus at the same time, each using a separate set of pedals facing each other grasping the same handles with elongated hand grips.

In an alternative embodiment, the framework has been extended moving the foot support member pivot further from the crank. The first pair of pedals are in sliding contact with the foot support members to form foot trolleys which allow back and forth movement of the feet while the foot support members provide an up and down treadle movement. The trolleys are shown free to provide any combination of back and forth motion the operator desires. With the proper material choices, the friction between trolley and foot support members can impose a load resistance to the back and forth foot movement. Alternately, the trolleys can have rollers to replace the sliding contact of the pedals with back and forth easy movement on the foot support members. Cable or belt can be added to impose alternating trolley movement.

The second pair of pedals are pivotally attached to the other end of the treadles distal the first pair of pedals. The pivot attachment allows limited rotation for the feet during the up and down treadle movement. The connecting links and crank are similar to the preferred embodiment.

The handles are adjustably attached to the connecting links to allow positioning of the hand grips for either set of pedals. In either embodiment, the handle motion is phased to prevent dead center problems common to crank driven treadles.

Operation begins with feet of the operator upon the pedal trolleys and grasping the hand grips. As the hands initiate motion of the crank, the treadles begin the up and down movement. The operator can chose to leave the trolleys side by side close to the foot support pivot for short up and down movement or move the trolleys closer to the crank for higher pedal lift. The operator can also choose to move the trolleys back and forth in concert with the up and down treadle motion.

Operation of the second set of pedals is possible after the handles have been repositioned to a different adjustment hole. As the hand grips follow a reversible elliptical path, the pedals move up and down allowing the angle of pedals to be different than the angles of treadles.

In both embodiments, a flywheel is used with adjustable friction belt load resistance to ensure smooth motion with effort. Of course, other forms of adjustable load resistance such as alternator, magnetic, air fan, etc. can be used in lieu of the friction belt.

In summary, this invention provides the operator with stable foot pedal support having adjustable intensity motions that simulate speed walking and climbing with very low joint impact while offering reversible elliptical hand motion for coordinated upper body exercise.

BRIEF DESCRIPTION OF THE DRAWINGS

The foregoing and other objects and features of the present invention will become more fully apparent from the following description and claims, taken in conjunction with the drawings. Understanding that these drawings depict only typical embodiments of the invention and are, therefore, not to be considered limiting of its scope or combinations, the invention will be described with addition specificity and detail through use of the accompanying drawings in which:

DETAILED DESCRIPTION OF THE EMBODIMENTS

Figure 1:
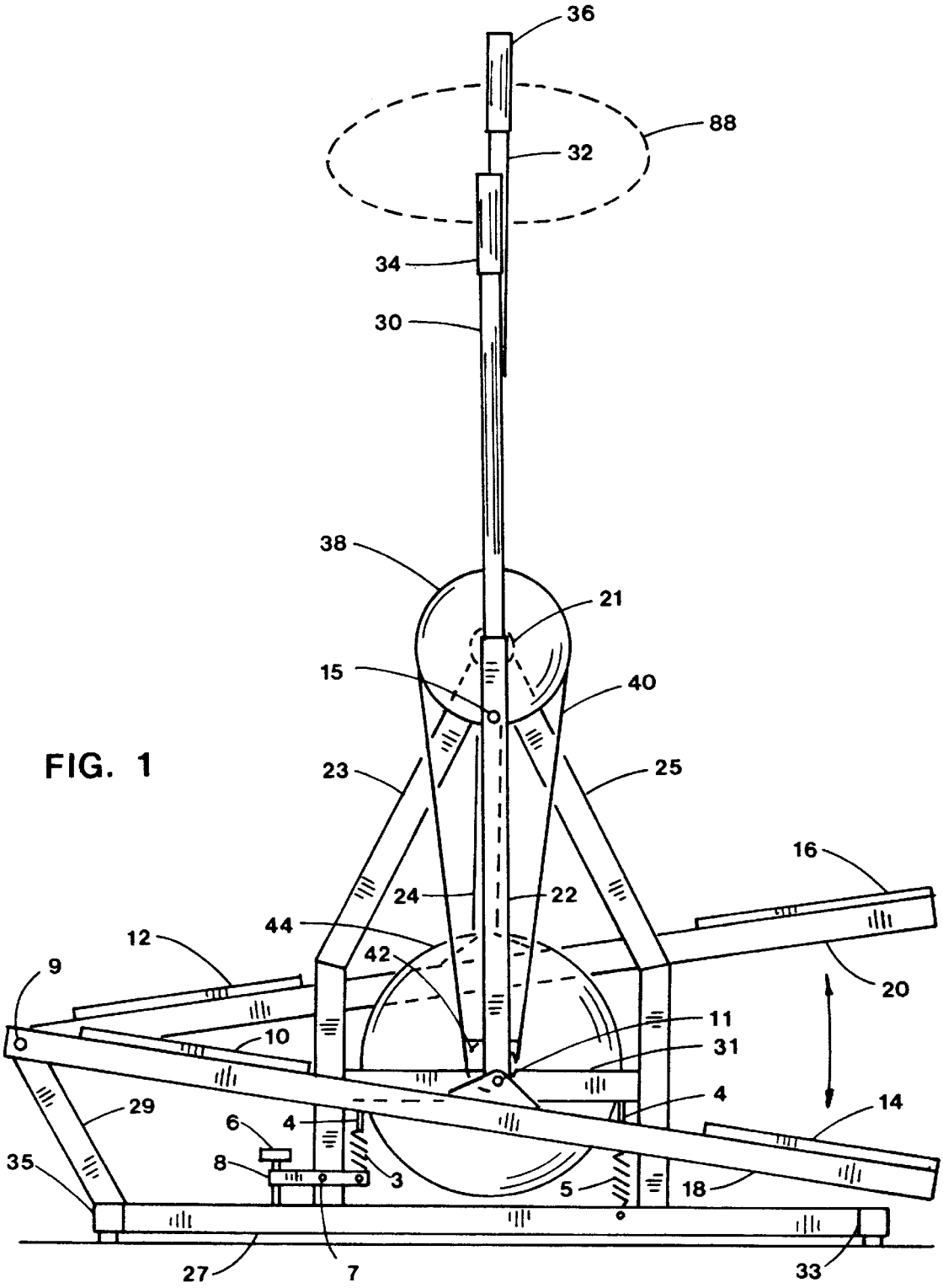
FIG. 1 is a right side elevation view of the preferred embodiment of an exercise machine constructed in accordance with the present invention.
Figure 2:
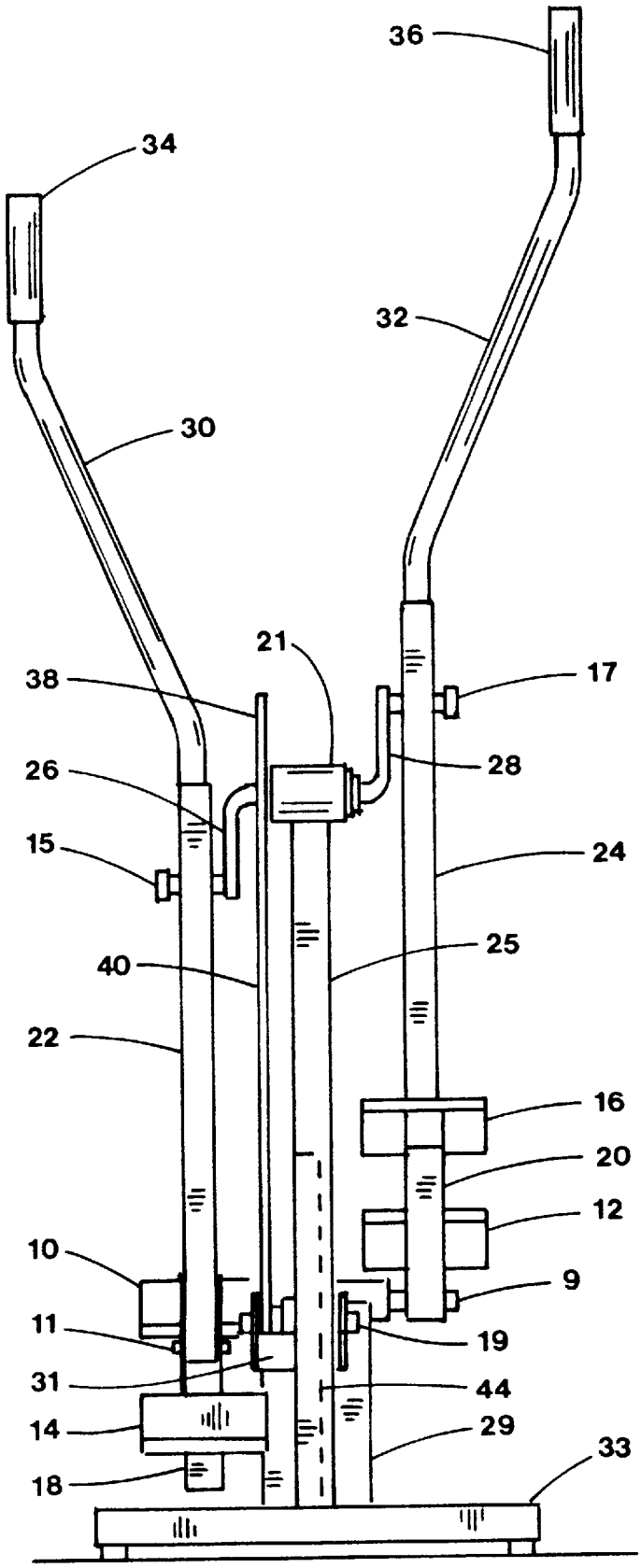
FIG. 2 is the front view of the preferred embodiment shown in FIG. 1.

Referring to the drawings in detail, treadles 18,20 are shown in FIGS. 1 and 2 in the most upward and downward positions of the preferred embodiment. Treadles 18,20 are connected to frame member 29 at pivot 9 located at one end of the exercise apparatus. Connecting links 22,24 are connected to treadles 18,20 at pivots 11,13 and to crank 26,28 at pivots 15,17. Cranks 26,28 are connected in generally opposing directions within crank bearing housing 21.

First pedals 10,12 are attached to one end of the treadles 18,20 while second pedals 14,16 are attached at the other end. Handles 30,32 with hand grips 34,36 are attached to connecting links 22,24. Hand grips 34,36 follow elongate curve 88.

Sprocket 38 is attached to crank 26 and is rotatably engaged to sprocket 42 by chain 40. Sprocket 42 drives flywheel 44 which is rotatably attached to the frame member 31 at axle 19. Friction belt 4 is wrapped around flywheel 44 and terminates at springs 3,5. Adjustment knob 6 provides varying spring 3,5 tension for different load resistance through bracket 8 pivoted at 7 to frame member 23.

Frame members 27,35,33 are configured to be supported by the floor. Upright frame members 29,23,25 are attached to base 27. Crank bearing housing 21 is attached to upright frame members 23,25 as is the flywheel support 31.

Figure 3:
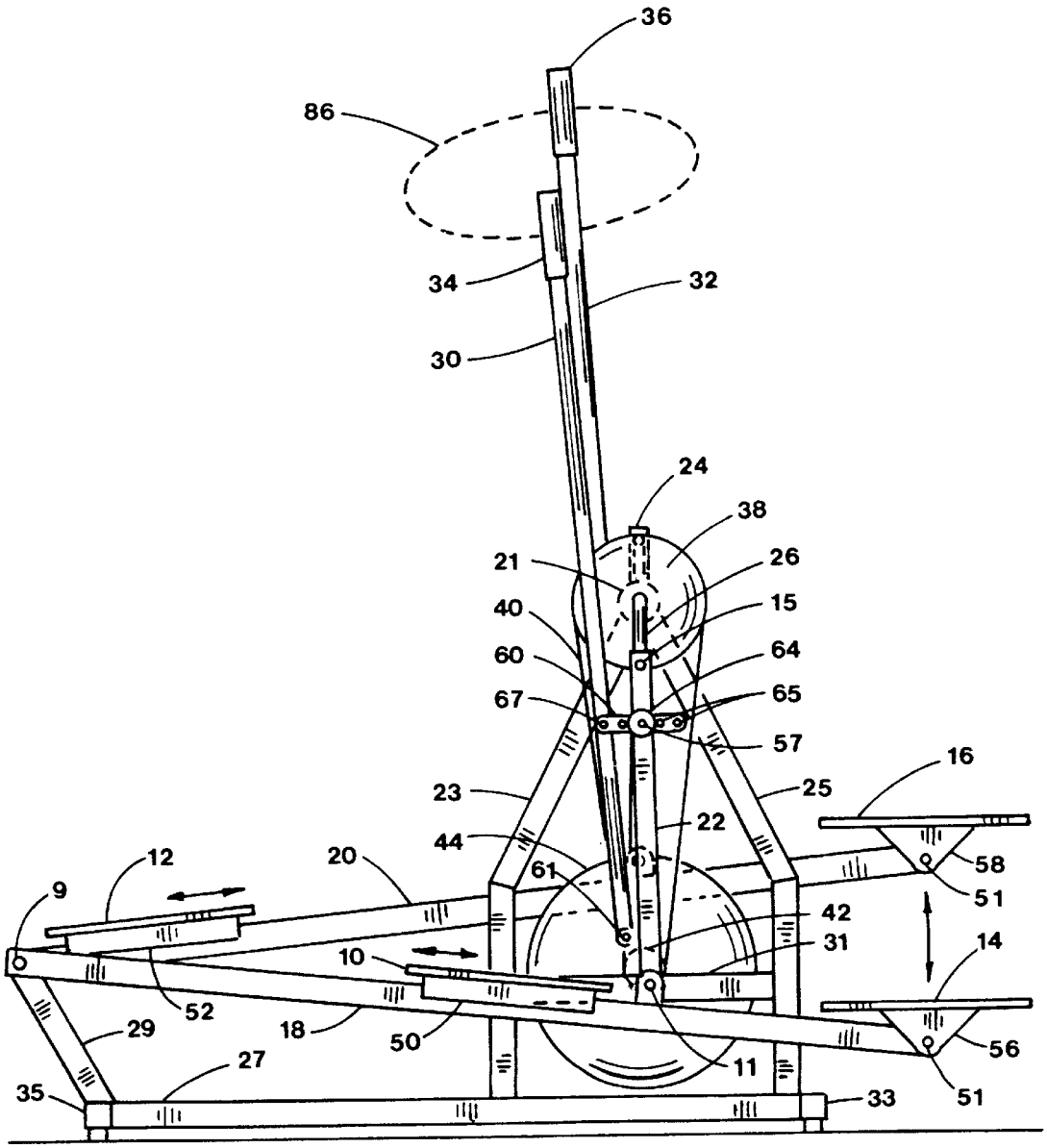
FIG. 3 is a right side elevation of the alternate embodiment.

An alternative embodiment shown in FIG. 3 has treadles 18,20 connected to frame member 29 by pivot 9 and to connecting links 22,24 at pivots 11,13. First pair of pedals 10,12 are slidably mounted to treadles 18,20 to form trolleys 50,52 which can move back and forth along treadles 18,20. A second set of pedals 14,16 are connected to treadles 18,20 by pedal brackets 56,58 at pivots 51.

Handles 30,32 are connected to connecting links 22,24 at pivots 61 and to adjustment links 60,62 at pivot 67. Adjustment links 60,62 have a series of holes 65 which can be selected to be secured to threaded connections 57 by knobs 64. Use of alternate holes 65 reposition hand grips 34,36 for use with either set of pedals 10,12 or 14,16. Hand grips 34,36 follow elongate curve 86. The drive assembly and framework are similar to the preferred embodiment and use common markings.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine comprising;

a framework means, said framework means configured to be supported on the floor;

a crank means pivotally connected to said framework means, said crank means projecting outwardly therefrom on both sides thereof;

a pair of treadle means, each said treadle means having a treadle pivot means attached to said framework means disposed rearward thereof;

a pair of connecting link means, each connecting link means pivotally interposed between said crank means and each said treadle means;

a pair of pedal means, each said pedal means operably associated with one of said treadle means;

each said pedal means having generally opposing arcuate up and down pedal movement relative to said framework means when the foot of the user is rotating said crank means whereby of the user the toe on each said pedal means moves generally faster than the heel of the foot during at least a portion of said pedal movement.

2. The exercise machine according to claim 1 wherein said pedal means further comprises a trolly means to be movable along the length of said treadle means whereby the foot of the operator can experience different up and down movement.

3. The exercise machine according to claim 1 further comprising a pair of second pedal means operably associated with said treadle means positioned distal said treadle pivot means whereby the heel on said pedal means moves generally faster than the toe of the foot during at least a portion of said pedal movement.

4. The exercise machine according to claim 1 further comprising a handle means, said handle means operably associated with said connecting link means whereby said handle means provides arm exercise.

5. The exercise machine according to claim 4 wherein said handle means further comprises a hand grip means whereby said hand grip means follows an elongate curve path.

6. The exercise machine according to claim 4 wherein said handle means further comprises an adjustment means whereby said handle means can be repositioned relative to the operator.

7. The exercise machine according to claim 1 wherein said pedal means is pivotally attached to said treadle means whereby the angular movement of said pedal means can be different than said treadle means.

8. The exercise machine according to claim 3 wherein said pedal means is movable along the length of said treadle means whereby the foot of the operator can experience different up and down movement.

9. The exercise machine according to claim 3 wherein said second pair of pedal means is pivotally attached to said treadle means whereby the angular movement of said pedal means can be different than said treadle means.

10. The exercise machine according to claim 1 further comprising a load resistance means operably associated with said crank means.

11. The exercise machine according to claim 2 wherein said trolley means further comprises roller means, said roller means operably associated with said treadle means to provide back and forth foot movement.

12. The exercise machine according to claim 2 wherein said trolley means is slidable relative to said treadle means with controlled friction whereby said trolley means has load resistance to back and forth movement.

13. An exercise machine comprising;

a framework means, said framework means configured to be supported on the floor;

a pair of treadle means, each said treadle means having a treadle pivot means attached to said framework means;

a treadle movement means, said treadle movement means operably associated with each said treadle means to provide generally up and down movement;

a pair of first pedal means, each said first pedal means operably associated with one of said treadle means;

a pair of second pedal means, each said second pedal means operably associated with one of said treadle means;

said first and second pedal means having generally up and down pedal movement relative to said framework means when the foot of the user is operating said treadle means whereby of the user the toe on said first pedal means moves generally faster than the heel of the foot while the heel on said second pedal means moves generally faster than the toe of the foot during at least a portion of said pedal movement.

14. The exercise machine according to claim 13 wherein said treadle movement means further comprises a crank means pivotally connected to said framework means, said crank means projecting outwardly therefrom on both sides thereof, operably associated with each said treadle means.

15. The exercise machine according to claim 14 wherein said treadle movement means further comprises a pair of connecting link means, each connecting link means pivotally interposed between said crank means and each said treadle means.

16. The exercise machine according to claim 13 further comprising a handle means, said handle means operably associated with said treadle movement means whereby said handle means provides arm exercise.

17. The exercise machine according to claim 16 wherein said handle means further comprises a hand grip means whereby said hand grip means follows an elongate curve path.

18. The exercise machine according to claim 16 wherein said handle means further comprises an adjustment means whereby said handle means can be repositioned relative to the operator.

19. The exercise machine according to claim 13 wherein said first pedal means is movable along the length of said treadle means whereby the foot of the operator can experience different up and down movement.

20. The exercise machine according to claim 13 wherein said second pair of pedal means is pivotally attached to said treadle means whereby the angular movement of said pedal means can be different than said treadle means.

21. The exercise machine according to claim 13 wherein said first pair of pedals can be used by a first operator and said second pair of pedals can be used by a second operator whereby both operators exercise at the same time.

22. An exercise machine comprising;

a framework means, said framework means configured to be supported on the floor;

a treadle means, said treadle means having a treadle pivot means attached to said framework means;

a treadle movement means, said treadle movement means operably associated with said treadle means to provide generally up and down movement;

a pedal means, said pedal means operably associated with said treadle means;

a handle means, said handle means operably associated with said treadle movement means for providing for an elliptical arm exercise movement;

said pedal means having generally up and down pedal movement relative to said framework means when the foot of the user is operating said treadle means whereby the handle means follows an elongate curve path.

23. The exercise machine according to claim 22 wherein said handle means further comprises an adjustment means whereby said handle means can be repositioned relative to the operator.

24. The exercise machine according to claim 22 further comprising a second pedal means, said second pedal means operably associated with said treadle means having generally up and down movement different than said pedal means.

25. The exercise machine according to claim 22 wherein said pedal means further comprises a trolley means to be movable along at least a portion of the length of said treadle means whereby the foot of the operator can experience different up and down movement.

26. The exercise machine according to claim 25 wherein said trolley means further comprises roller means, said roller means operably associated with said treadle means to provide back and forth foot movement.

* * * * *